US006096152A

United States Patent [19]

Anderson et al.

[11] Patent Number: 6,096,152

[45] Date of Patent: Aug. 1, 2000

[54] CREPED TISSUE PRODUCT HAVING A LOW FRICTION SURFACE AND IMPROVED WET STRENGTH

[75] Inventors: Ralph L. Anderson, Marietta, Ga.; Richard R. Hepford, Folcroft, Pa.

[73] Assignee: Kimberly-Clark Worldwide, Inc., Neenah, Wis.

[21] Appl. No.: 08/846,799

[22] Filed: Apr. 30, 1997

[51] Int. Cl.[7] ..... B31F 1/12; D21H 23/00

[52] U.S. Cl. ..... 156/183; 162/111; 162/129; 162/146

[58] Field of Search ..... 156/183; 162/111, 162/112, 113, 129, 130, 146

[56] References Cited

U.S. PATENT DOCUMENTS

| | | |
|---|---|---|
| Re. 28,459 | 7/1975 | Cole et al. . |
| 3,432,936 | 3/1969 | Cole et al. . |
| 3,476,644 | 11/1969 | Krehnbrink . |
| 3,755,220 | 8/1973 | Freimark et al. . |
| 3,821,068 | 6/1974 | Shaw . |
| 3,879,257 | 4/1975 | Gentile et al. . |
| 3,903,342 | 9/1975 | Roberts, Jr. . |

(List continued on next page.)

FOREIGN PATENT DOCUMENTS

| | | |
|---|---|---|
| 37775 85 | of 0000 | Australia . |
| 1176986 | 10/1984 | Canada . |
| 1195562 | 10/1985 | Canada . |
| 2095554 | 8/1994 | Canada . |
| 2118529 | 2/1996 | Canada . |
| 0116512A1 | 8/1984 | European Pat. Off. . |
| 0347154B1 | 12/1989 | European Pat. Off. . |
| 0677612A2 | 10/1995 | European Pat. Off. . |
| 1241054 | 8/1960 | France . |
| 2006296 | 5/1979 | United Kingdom . |
| 2057528 | 4/1981 | United Kingdom . |
| 2121449A | 12/1983 | United Kingdom . |
| 2152961A | 8/1985 | United Kingdom . |
| 8200485 | 2/1982 | WIPO . |
| 9401620 | 1/1994 | WIPO . |
| 9501479 | 1/1995 | WIPO . |
| 9510661 | 4/1995 | WIPO . |
| 9621768 | 1/1996 | WIPO . |
| 9621769 | 1/1996 | WIPO . |
| 9633310 | 3/1996 | WIPO . |

*Primary Examiner*—Richard Crispino
*Assistant Examiner*—Sue A. Purvis
*Attorney, Agent, or Firm*—Dority & Manning, P.A.

[57] ABSTRACT

The present invention is generally directed to facial tissues having great softness and strength. The facial tissues are made from a multi-layered paper web containing a middle layer of eucalyptus fibers either alone or in combination with polyester fibers. The paper web is made with a debonding agent for producing a web having reduced levels of fiber bonding. Once formed, the paper web is treated on each side with a bonding agent in a preselected pattern. Both sides of the paper web are also creped. In order to create a smooth low friction surface, the paper web is fed through a calendering machine and treated with a friction reducing composition and subsequently dried.

29 Claims, 5 Drawing Sheets

U.S. PATENT DOCUMENTS 4,000,237 12/1976 Roberts, Jr. .
4,036,684 7/1977 Schmitt et al. .
4,061,775 12/1977 Dybas et al. ..... 424/330
4,125,659 11/1978 Klowak et al. .
4,144,122 3/1979 Emanuelsson et al. .
4,158,594 6/1979 Becker et al. .
4,166,001 8/1979 Dunning et al. ..... 162/111
4,179,330 12/1979 Page .
4,208,459 6/1980 Becker et al. .
4,225,382 9/1980 Kearney et al. .
4,300,981 11/1981 Carstens .
4,326,000 4/1982 Roberts, Jr. .
4,351,699 9/1982 Osborn, III .
4,384,130 5/1983 Martin .
4,420,372 12/1983 Hostetler .
4,425,186 1/1984 May et al. .
4,429,014 1/1984 Isner et al. .
4,432,833 2/1984 Breese .
4,441,962 4/1984 Osborn, III .
4,447,294 5/1984 Osborn, III .
4,448,638 5/1984 Klowak .
4,481,243 11/1984 Allen .
4,482,429 11/1984 Klowak .
4,507,173 3/1985 Klowak et al. .
4,513,051 4/1985 Lavash .
4,720,383 1/1988 Drach et al. ..... 424/70
4,795,530 1/1989 Soerens et al. .
4,859,527 8/1989 DiStefano .
4,894,118 1/1990 Edwards et al. .
4,913,773 4/1990 Knudsen et al. .
4,940,513 7/1990 Spendel .
4,942,077 7/1990 Wendt et al. .
4,963,230 10/1990 Kawase et al. .
4,986,882 1/1991 Mackey et al. .
5,059,282 10/1991 Ampulski et al. .
5,098,519 3/1992 Ramasubramamian et al. .
5,098,979 3/1992 O'Lenick, Jr. ..... 528/15
5,102,501 4/1992 Eber et al. .
5,129,988 7/1992 Farrington et al. .
5,147,505 9/1992 Altman ..... 162/129
5,164,045 11/1992 Awofeso et al. .
5,164,046 11/1992 Ampulski et al. .
5,215,626 6/1993 Ampulski et al. .
5,217,576 6/1993 Van Phan .
5,223,096 6/1993 Phan et al. .
5,240,562 8/1993 Phan et al. .
5,246,545 9/1993 Ampulski et al. .
5,246,546 9/1993 Ampulski .
5,262,007 11/1993 Phan et al. .
5,264,082 11/1993 Phan et al. .
5,277,761 1/1994 Van Phan et al. .
5,279,767 1/1994 Phan et al. .
5,312,522 5/1994 Van Phan et al. .
5,334,286 8/1994 Van Phan et al. .
5,354,425 10/1994 Mackey et al. .
5,385,642 1/1995 Van Phan et al. .
5,385,643 1/1995 Ampulski .
5,389,204 2/1995 Ampulski .
5,397,435 3/1995 Ostendorf et al. .
5,399,241 3/1995 Oriaran et al. .
5,405,501 4/1995 Phan et al. .
5,415,737 5/1995 Phan et al. .
5,427,696 6/1995 Phan et al. .
5,437,766 8/1995 Van Phan et al. .
5,437,908 8/1995 Demura et al. .
5,443,691 8/1995 Phan et al. .
5,474,689 12/1995 Laughlin et al. .
5,487,813 1/1996 Vinson et al. .
5,492,598 2/1996 Hermans et al. .
5,494,554 2/1996 Edwards et al. .
5,494,731 2/1996 Fereshtehkhou et al. .
5,505,818 4/1996 Hermans et al. .
5,510,000 4/1996 Phan et al. .
5,510,001 4/1996 Hermans et al. .
5,510,002 4/1996 Hermans et al. .
5,527,560 6/1996 Fereshtehkhou et al. .
5,529,665 6/1996 Kaun ..... 162/111
5,538,595 7/1996 Trokhan et al. .
5,543,067 8/1996 Phan et al. .
5,552,020 9/1996 Smith et al. .
5,558,873 9/1996 Funk et al. .
5,562,805 10/1996 Kamps et al. .
5,573,637 11/1996 Ampulski et al. .
5,575,891 11/1996 Trokhan et al. .
5,578,170 11/1996 Erikson et al. .
5,591,306 1/1997 Kaun .
5,595,828 1/1997 Weber et al. ..... 428/537.5
5,614,293 3/1997 Krzysik et al. ..... 428/211
5,622,786 4/1997 Weber et al. ..... 428/537.5
5,674,590 10/1997 Anderson et al. .
5,776,306 7/1998 Hepford .

CREPED TISSUE PRODUCT HAVING A LOW FRICTION SURFACE AND IMPROVED WET STRENGTH

FIELD OF THE INVENTION

The present invention is generally directed to a method for producing a single ply, ultra soft facial tissue. More particularly, the present invention is directed to a single ply soft facial tissue containing a middle layer of eucalyptus fibers. The tissue product is made by applying a latex bonding agent and creping each side of the paper web. In order to reduce the surface friction of the tissue, the paper web is then calendered and an anti-friction agent is applied.

BACKGROUND OF THE INVENTION

Absorbent paper products such as paper towels, facial tissues and other similar products are designed to include several important properties. For example, the products should have good bulk, a soft feel and should be highly absorbent. The product should also have good strength even while wet and should resist tearing. Unfortunately, it is very difficult to produce a high strength paper product that is also soft and highly absorbent. Usually, when steps are taken to increase one property of the product, other characteristics of the product are adversely affected. For instance, softness is typically increased by decreasing or reducing fiber bonding within the paper product. Inhibiting or reducing fiber bonding, however, adversely affects the strength of the paper web.

One particular process that has proved to be very successful in producing paper towels and wipers is disclosed in U.S. Pat. No. 3,879,257 to Gentile, et al., which is incorporated herein by reference in its entirety. In Gentile, et al., a process is disclosed in which a bonding material is applied in a fine, spaced apart pattern to one side of a fibrous web. The web is then adhered to a creping surface and creped from the surface. A bonding material is applied to the opposite side of the web and the web is similarly creped. The process disclosed in Gentile, et al. produces wiper products having exceptional bulk, outstanding softness and good absorbency. The surface regions of the web also provide excellent strength, abrasion resistance, and wipe-dry properties.

Although Gentile, et al. discloses a method for producing paper towels with improved properties, thus far, the process has not been found particularly well adapted for producing facial tissues. In comparison to the products produced in Gentile, et al., facial tissues must have a much softer feel. In fact, since one of the primary uses of facial tissues is for application to an individual's face, softness is perhaps the most important characteristic of the product.

Besides lacking softness, products made according to Gentile, et al. are also generally too rough or coarse for use as facial tissues. Again, because facial tissues are placed in contact with a user's face, the tissue should have a smooth, low friction surface.

Although the process disclosed in Gentile, et al. was not specifically directed to the production of facial tissues, it would, however, be particularly advantageous if particular aspects of the teachings disclosed in Gentile, et al. could be incorporated into methods for producing facial tissues. For instance, the method disclosed in Gentile, et al. has proven to be effective in increasing the strength and absorbency of wiper products. Thus, it would be particularly desirable if particular aspects of Gentile, et al. could be used to produce soft, low friction facial tissues having enhanced wet and dry strength characteristics, stretch properties, and tear resistant properties.

SUMMARY OF THE INVENTION

The present invention recognizes and addresses the foregoing drawbacks, and deficiencies of prior art constructions and methods.

Accordingly, it is an object of the present invention to provide an improved process for producing facial tissues.

Another object of the present invention is to provide a method for producing facial tissues that are soft and have a low friction surface.

Another object of the present invention is to provide a method for producing soft facial tissues that have a high dry strength, a high wet strength and are tear resistant.

Another object of the present invention is to provide a method for producing facial tissues that are resistant to fuzzing and do not produce significant amounts of lint during use.

Still another object of the present invention is to provide a method for producing facial tissues that incorporates soft eucalyptus fibers sandwiched between two outer layers of softwood fibers.

It is another object of the present invention to provide a method for producing facial tissues by applying a bonding agent to both sides of a paper web in a preselected pattern and creping each side of the web.

It is another object of the present invention to provide a method for producing a facial tissue which involves calendering a double creped paper web and then applying a non-fugitive anti-friction agent to the web.

These and other objects of the present invention are achieved by providing a method for producing a single ply soft tissue. The method includes the steps of providing a paper web including a middle layer containing eucalyptus fibers. The middle layer is surrounded by a first debonded outer layer containing softwood fibers and a second debonded outer layer also containing softwood fibers.

A first bonding agent is applied to a first side of the web in a preselected pattern. The first side of the web is then adhered to a first creping surface and creped. Similarly, a second bonding agent is applied to the second side of the web in a preselected pattern and adhered to a second creping surface. The second side of the web is then creped from the second creping surface.

The method further includes the step of applying to at least one side of the paper web a friction reducing agent. For instance, in one embodiment, the friction reducing agent comprises a quaternary silicone composition. The silicone composition can be added to the web in an amount from about 0.4% to about 2% by weight.

In accordance with the present invention, in order to inhibit interfiber bonding during formation of the paper web, a debonding agent can be added to a fiber slurry used to make the web. The debonding agent can be added in an amount from about 0.2% to about 1% by weight based on the total weight of fibers contained in the web.

In one preferred embodiment, the paper web also includes short polyester staple fibers contained in the middle layer combined with the eucalyptus fibers. The polyester fibers can be added to the paper web in an amount from about 5% to about 20% by weight.

The first bonding agent and the second bonding agent that are applied to each side of the paper web can be applied in a pattern that covers from about 30% to about 60%, and more particularly from about 40% to about 50% of the surface area of each side. The bonding agent can be applied to each side of the paper web in a combined amount of from about 4% to about 7% by weight. Once applied, each of the bonding agents can penetrate the web in an amount from about 25% to about 40% of the total thickness of the web.

The preselected pattern used to apply the bonding agents can be, in one embodiment, a reticular, interconnected design. Alternatively, the preselected pattern can comprise a succession of discrete dots. In one preferred embodiment, the first bonding agent and the second bonding agent comprise an ethylene vinyl acetate copolymer cross-linked with N-methyl acrylamide groups. Copolymers of vinyl acrylics with cross-linking capability are also useful.

Prior to adding the friction reducing agent, the method of the present invention can further include the step of calendering the paper web. Calendering the paper web smooths out the surface of the web for reducing roughness and for facilitating application of the friction reducing agent.

Once formed, the single ply soft tissue of the present invention can have a basis weight of from about 20 to about 25 pounds per ream. Besides being soft, tissues made according to the present invention are also very strong and stretchable. For instance, in one embodiment the tissue has a wet strength of at least 5 ounces in the cross direction.

These and other objects of the present invention are also achieved by providing, in one preferred embodiment, a method for producing tissues comprising the steps of first providing a previously creped three-layered paper web. The paper web includes a middle layer containing a mixture of eucalyptus and polyester fibers surrounded by a first outer layer containing softwood fibers and a second outer layer also containing softwood fibers. The paper web includes a debonding agent added during formation of the web.

A bonding agent is applied in a preselected pattern to each side of the web. More particularly, the bonding agent is added in an amount that covers from about 40% to about 50% of the surface area of each side of the web. The bonding agent is added to each side of the web in an amount from about 2% to about 3.5% by weight.

Each side of the paper web is creped from a creping surface after the bonding agent is applied. After creping both sides of the web, the web is calendered to increase the smoothness of the surfaces. A friction reducing agent is then applied by spraying or printing to at least one side of the web. The friction reducing agent can be, for instance, a water dispersion of a quaternary silicone which, upon drying, becomes somewhat substantive to the cellulose surface.

Other objects, features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
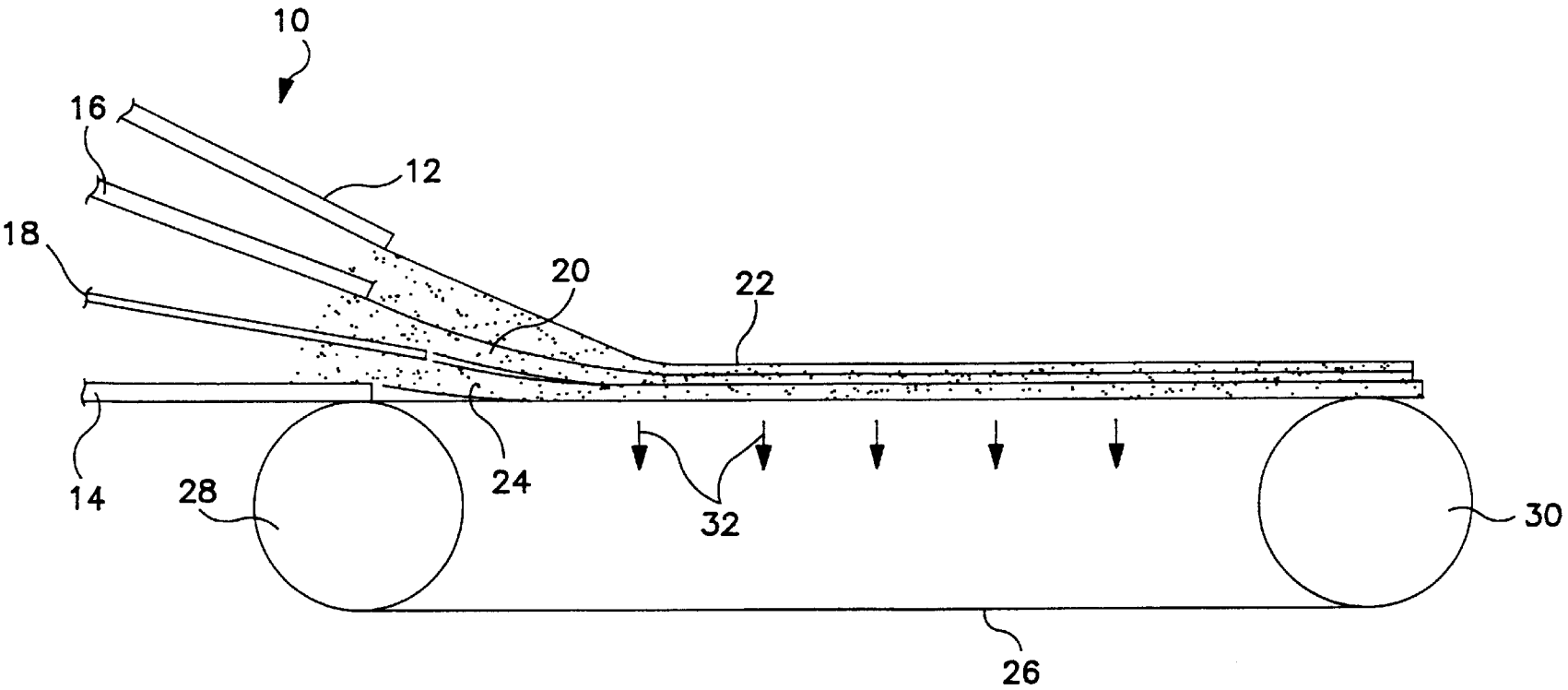
FIG. 1 is a schematic diagram of a paper web forming machine, illustrating the formation of a paper web having multiple layers in accordance with the present invention.

Repeat use of reference characters in the present specification and drawings is intended to represent same or analogous features or elements of the present invention.

DETAILED DESCRIPTION OF THE PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a process for producing facial tissues having great softness characteristics and having smooth, low friction surfaces. Besides being soft and smooth, the facial tissues also have high strength values when either dry or wet. Further, the tissues have good stretch characteristics, are tear resistant, and do not produce a substantial amount of lint when in use.

The process of the present invention generally involves applying a bonding agent and creping both sides of a paper web. The bonding agent is applied in a preselected pattern for providing strength and stretchability without adversely affecting the softness of the sheet. Once creped on both sides, in order to create a low friction tissue, the paper web is calendered. After calendering, an anti-friction agent can also be applied to the web. Preferably, the anti-friction agent bonds with the cellulosic fibers and thus does not transfer to the face of the user when in use.

Facial tissues made according to the present invention are produced from a multi-layer paper web. More particularly, the tissues are made from a stratified pulp furnish having three principle layers. In accordance with the present invention, the middle layer of the paper web contains eucalyptus fibers.

Eucalyptus fibers, which are typically from about 0.8 to 1.2 mm in length, provide uniform formation and greatly increase the softness of the web. The eucalyptus fibers also enhance the brightness and increase the opacity of the paper. Further, the eucalyptus fibers change the pore structure of the paper, greatly increasing the wicking ability of the paper web. By placing eucalyptus fibers in the middle of the web, wetness contacting the surface of the web is drawn into the center.

Unfortunately, incorporating eucalyptus fibers into the paper web increases lint production. According to the present invention, however, lint released from the tissue is minimized by placing the layer of eucalyptus fibers between outer layers made from other types of fibers. For instance, the outer layers of the paper web can be made from fibers that are generally longer than eucalyptus fibers. For example, in one embodiment, northern softwood kraft fibers can be used to form the outer layers. Northern softwood kraft fibers have a fiber length of about 1.8 mm to about 2.5 mm. These particular fibers not only prevent lint from escaping the center of the paper web but also further enhance the strength of the web.

The amount of eucalyptus fibers incorporated into the paper web of the present invention can be from about 10% to about 35% by weight, based upon the total weight of the web. The remainder of the web can comprise the outer layers of softwood fibers. In one preferred embodiment, however, polyester fibers having a length of about 5 mm can be added to the center layer and combined with the eucalyptus fibers in an amount from about 5% to about 20% by weight based on the total weight of the web. Adding polyester fibers to the middle layer increases the strength, softness and whiteness of the web.

The multi-layered base web according to the process of the present invention should be formed without a substantial amount of inner fiber to fiber bond strength. In this regard, the fiber furnish used to form the base web can be treated with a chemical debonding agent. The debonding agent can be added to the fiber slurry during the pulping process or can be added directly into the head box. Suitable debonding agents that may be used in the present invention include cationic debonding agents such as fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents are disclosed in U.S. Pat. No. 5,529,665 to Kaun which is incorporated herein by reference. In particular, Kaun discloses the use of cationic silicone compositions as debonding agents.

In one preferred embodiment, the debonding agent used in the process of the present invention is an organic quaternary ammonium chloride and particularly a silicone based amine salt of a quaternary ammonium chloride. In this embodiment, the debonding agent can be added to the fiber slurry in an amount from about 0.2% to about 1% by weight, based on the total weight of fibers present within the slurry.

Referring to FIG. 1, one embodiment of a device for forming a multi-layered stratified pulp furnish is illustrated. As shown, a three-layered head box generally 10 includes an upper head box wall 12 and a lower head box wall 14. Head box 10 further includes a first divider 16 and a second divider 18, which separate three fiber stock layers.

Each of the fiber layers comprise a dilute aqueous suspension of paper making fibers. In accordance with the present invention, as described above, middle layer 20 contains eucalyptus fibers either alone or in combination with polyester fibers. Outer layers 22 and 24, on the other hand, contain softwood fibers, such as northern softwood kraft.

An endless traveling forming fabric 26, suitably supported and driven by rolls 28 and 30, receives the layered paper making stock issuing from head box 10. Once retained on fabric 26, the layered fiber suspension passes water through the fabric as shown by the arrows 32. Water removal is achieved by combinations of gravity, centrifugal force and vacuum suction depending on the forming configuration.

Forming multi-layered paper webs is also described and disclosed in U.S. Pat. No. 5,129,988 to Farrington, Jr. and in U.S. Pat. No. 5,494,554 to Edwards, et al., which are both incorporated herein by reference.

Figure 2:
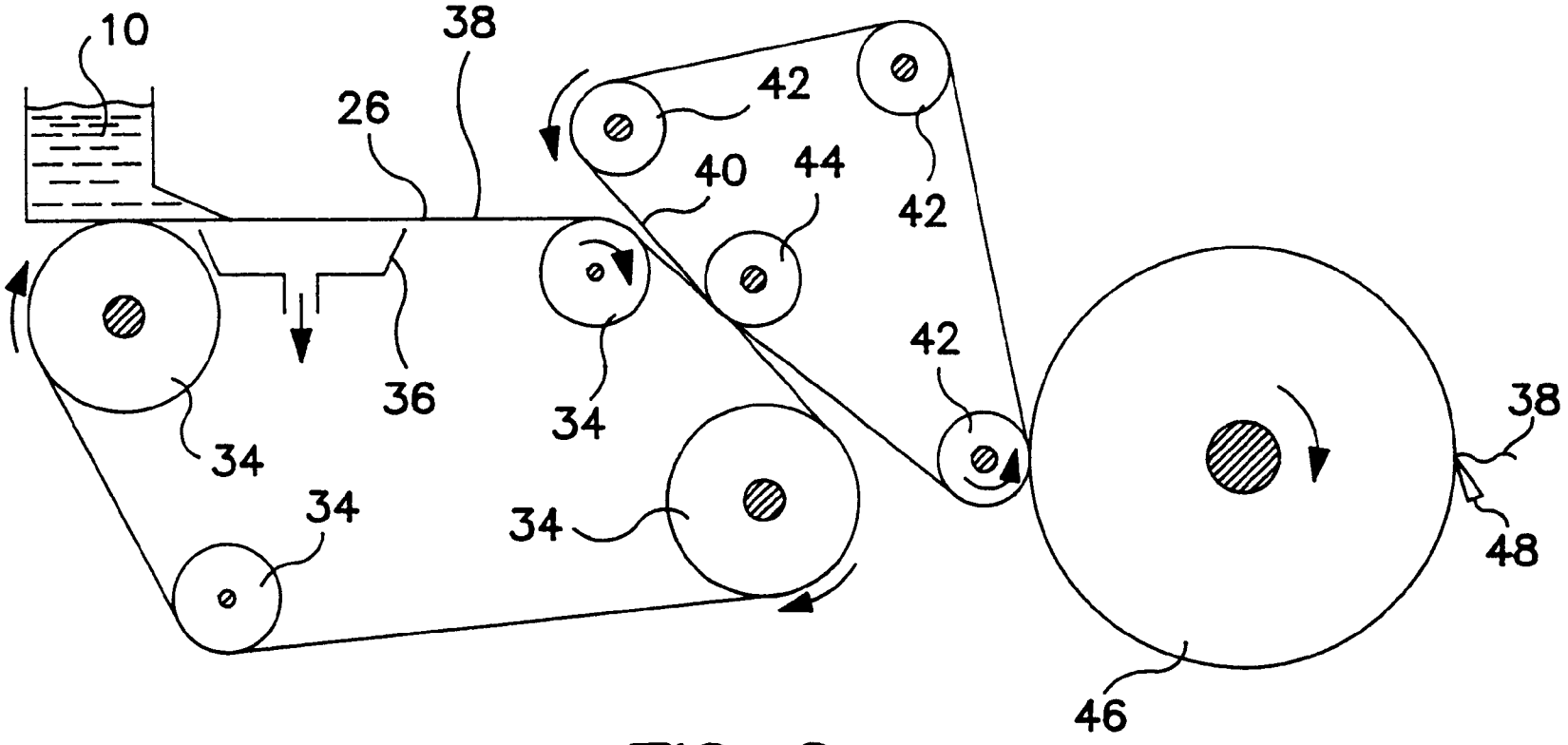
FIG. 2 is a schematic diagram of a paper web forming machine that crepes one side of the web.

Referring to FIG. 2, one embodiment of a paper making machine is illustrated capable of receiving the layered fiber suspension from head box 10 and forming a paper web for use in the process of the present invention. As shown, in this embodiment, forming fabric 26 is supported and driven by a plurality of guide rolls 34. A vacuum box 36 is disposed beneath forming fabric 26 and is adapted to remove water from the fiber furnish to assist in forming a web.

From forming fabric 26, a formed web 38 is transferred to a second fabric 40, which may be either a wire or a felt. Fabric 40 is supported for movement around a continuous path by a plurality of guide rolls 42. Also included is a pick up roll 44 designed to facilitate transfer of web 38 from fabric 26 to fabric 40. Preferably, the speed at which fabric 40 is driven is approximately the same speed at which fabric 26 is driven so that movement of web 38 through the system is consistent.

From fabric 40, web 38, in this embodiment, is transferred to the surface of a rotatable heated dryer drum 46, such as a Yankee dryer. Web 38 is lightly pressed into engagement with the surface of dryer drum 46 to which it adheres, due to its moisture content and its preference for the smoother of the two surfaces. In some cases, however, a creping adhesive, such as an ethylene vinyl acetate, can be applied over the web surface or drum surface for facilitating attachment of the web to the drum.

As web 38 is carried through a portion of the rotational path of the dryer surface, heat is imparted to the web causing most of the moisture contained within the web to be evaporated. Web 36 is then removed from dryer drum 46 by a creping blade 48. Although optional, creping web 38 as it is formed further reduces internal bonding within the web and increases softness.

In an alternative embodiment, web 38 can be through dried prior to being creped. A through dryer accomplishes the removal of moisture from the web by passing air through the web without applying any mechanical pressure. Through drying can increase the bulk and softness of the web.

The paper web formed from the process illustrated in FIG. 2, possesses certain physical characteristics that are particularly advantageous for use in the remainder of the process of the present invention. In particular, paper web 38 is characterized by having a reduced amount of inner fiber bonding strength. As described above, the web also contains eucalyptus fibers. Low bonding strength in combination with eucalyptus fibers provides softness, bulk, absorbency, opacity, wicking ability and brightness. As will be described hereinafter, the remainder of the process of the present invention is designed not only to enhance the above properties but also to provide the paper web with strength and stretchability.

Figure 3:
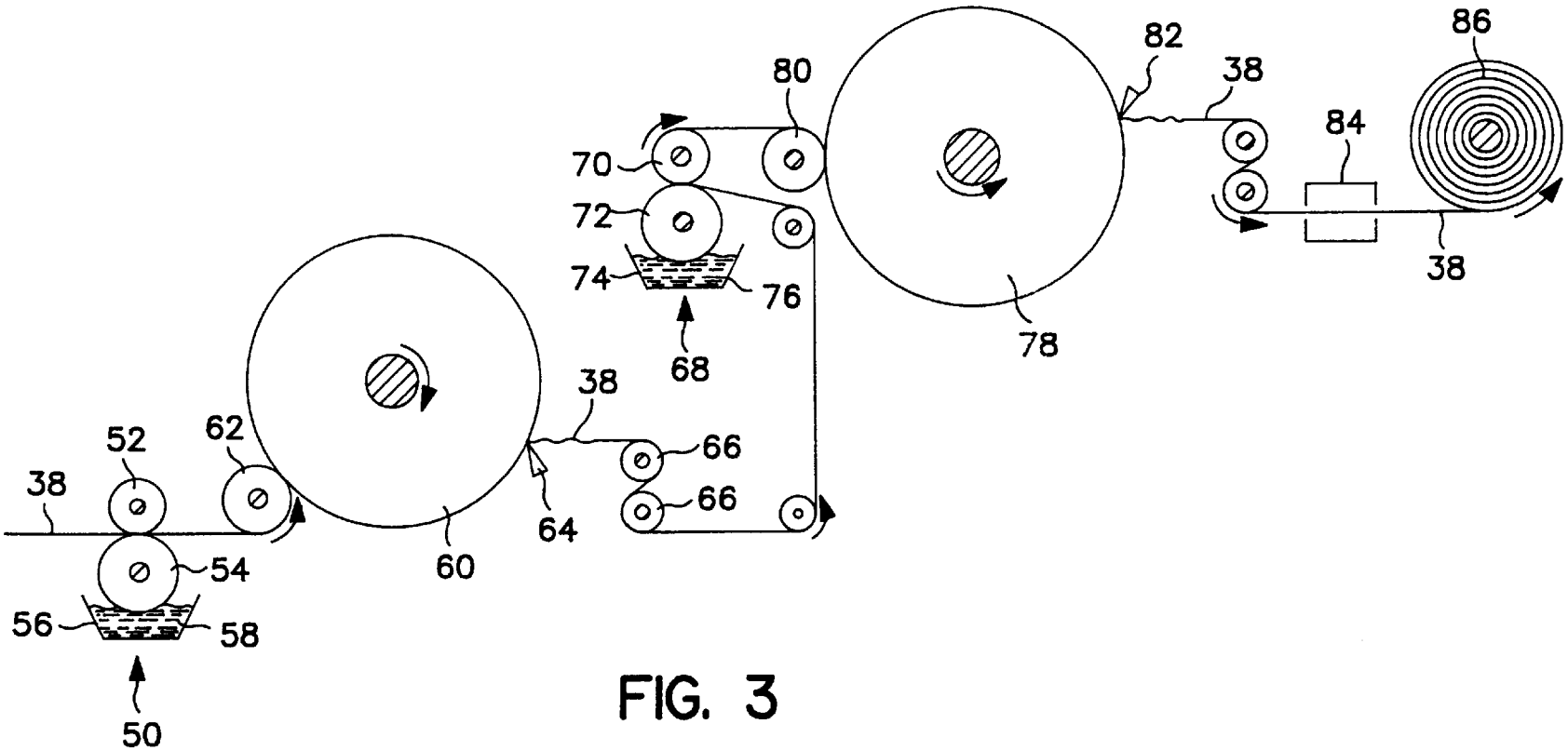
FIG. 3 is a schematic diagram of one embodiment of a system for double creping a paper web in accordance with the present invention.

Once paper web 38 is formed, a bonding agent is applied to each side of the web and each side of the web is then creped. Referring to FIG. 3, one embodiment of an apparatus that may be used to crepe each side of a paper web is illustrated.

As shown, paper web 38 made according to the process illustrated in FIG. 2 or according to a similar process, is passed through a first bonding agent application station generally 50. Station 50 includes a nip formed by a smooth rubber press roll 52 and a patterned rotogravure roll 54. Rotogravure roll 54 is in communication with a reservoir 56 containing a first bonding agent 58. Rotogravure roll 54 applies bonding agent 58 to one side of web 38 in a preselected pattern.

Web 38 is then pressed into contact with a first creping drum 60 by a press roll 62. The bonding agent causes only those portions of the web where it has been disposed to adhere to the creping surface. If desired, creping drum 60 can be heated for promoting attachment between the web and the surface of the drum and for partially drying the web.

Once adhered to creping drum 60, web 38 is brought into contact with a creping blade 64. Specifically, web 38 is removed from creping roll 60 by the action of creping blade 64, performing a first controlled pattern crepe on the web.

Once creped, web 38 can be advanced by pull rolls 66 to a second bonding agent application station generally 68. Station 68 includes a transfer roll 70 in contact with a rotogravure roll 72, which is in communication with a reservoir 74 containing a second bonding agent 76. Similar to station 50, second bonding agent 76 is applied to the opposite side of web 38 in a preselected pattern. Once the second bonding agent is applied, web 38 is adhered to a second creping roll 78 by a press roll 80. Web 38 is carried on the surface of creping drum 78 for a distance and then removed therefrom by the action of a second creping blade 82. Second creping blade 82 performs a second controlled pattern creping operation on the second side of the paper web.

Once creped for a second time, paper web 38, in this embodiment, is pulled through a curing or drying station 84. Drying station 84 can include any form of a heating unit, such as an oven energized by infrared heat, microwave energy, hot air or the like. Drying station 84 may be necessary in some applications to dry the web and/or cure the first and second bonding agents. Depending upon the bonding agents selected, however, in other applications drying station 84 may not be needed.

Figure 4:
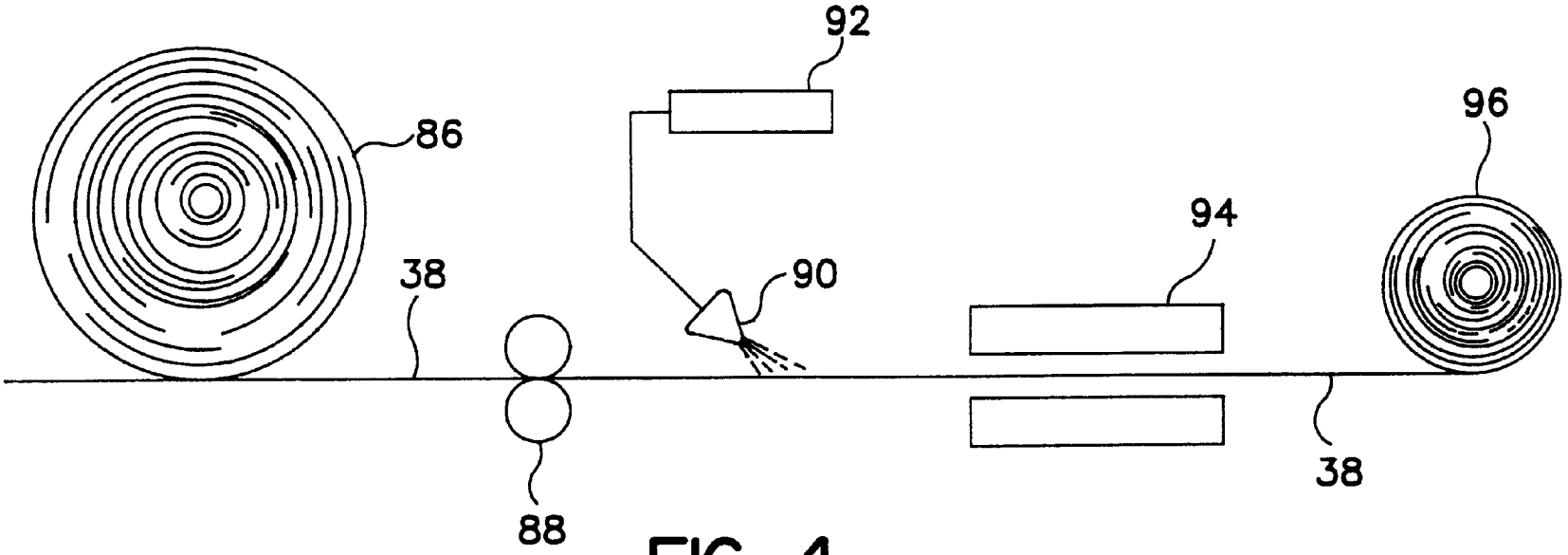
FIG. 4 is a schematic diagram of one embodiment of a system for calendering and applying a friction reducing agent to a paper web in accordance with the present invention.

Once drawn through drying station 84, web 38 can be wound into a roll of material 86 for further processing according to the present invention, as shown in FIG. 4. Alternatively, however, web 38 may be fed directly into further processing stations.

The bonding agents applied to each side of paper web 38 are selected for not only assisting in creping the web but also for adding dry strength, wet strength, stretchability, and tear resistance to the paper. The bonding agents also prevent lint from escaping from the tissue during use.

The bonding agent is applied to the base web as described above in a preselected pattern. In one embodiment, for instance, the bonding agent can be applied to the web in a reticular pattern, such that the pattern is interconnected forming a net-like design on the surface.

In an alternative preferred embodiment, however, the bonding agent is applied to the web in a pattern that represents a succession of boat-shaped dots. Applying the bonding agent in discrete shapes, such as dots, provides sufficient strength to the web without covering a substantial portion of the surface area of the web.

In particular, the bonding agents adversely affect the absorbency of the web. Thus, it is preferable to minimize the amount of bonding agent applied. In comparison to conventional processes, the process of the present invention is designed to require smaller amounts of the bonding agent. In this regard, the pattern applied to each side of the web should be compressed such that the dots are small and are arranged close together.

Specifically, according to the present invention, the bonding agent is applied to each side of the paper web so as to cover from about 30% to about 60% of the surface area of the web. More particularly, in most applications, the bonding agent will cover from about 40% to about 50% of the surface area of each side of the web. The total amount of bonding agent applied to each side of the web will preferably be in the range of from about 4% to about 7% by weight, based upon the total weight of the web. In other words, the bonding agent is applied to each side of the web at an add on rate of about 2% to about 3.5% by weight.

At the above amounts, the bonding agent can penetrate the paper web from about 25% to about 40% of the total thickness of the web. In most applications, the bonding agent should not penetrate over 50% of the web but should at least penetrate from about 10% to about 15% of the thickness of the web.

Particular bonding agents that may be used in the present invention include latex compositions, such as acrylates, vinyl acetates, vinyl chlorides, and methacrylates. Some water soluble bonding agents may also be used including polyacrylamides, polyvinyl alcohols, and carboxymethyl cellulose.

In one preferred embodiment, the bonding agent used in the process of the present invention comprises an ethylene vinyl acetate copolymer. In particular, the ethylene vinyl acetate copolymer is preferably cross-linked with N-methyl acrylamide groups using an acid catalyst. Suitable acid catalysts include ammonium chloride, citric acid, and maleic acid. The bonding agent should have a glass transition temperature of not lower than −10° F. and not higher than +20° F.

Referring to FIG. 4, the remaining processing steps according to the present invention include calendering the paper web and applying a friction reducing agent in order to provide a resulting tissue product having a smooth, low-friction surface. As shown in FIG. 4, the roll of material 86 formed according to the process illustrated in FIG. 3 is fed to a calendering machine 88. Calendering machine 88 can include two rolls, such as steel rolls, designed to make the surfaces of paper web 38 smooth. Although calendering machine 88 reduces, to a certain extent, the bulk of paper web 38, it has been discovered that the calendering operation does not appreciably affect the softness of the web. Besides providing a web with smooth surfaces, calendering machine 88 also provides a uniform surface for facilitating application of a friction reducing agent.

In this regard, from calendering machine 88, paper web 38 is brought into contact with a sprayer 90 which applies a friction reducing composition to the web from a reservoir 92. Besides being sprayed on paper web 38, the friction reducing composition can also be printed on the web using a lithographic printing fountain. The friction reducing composition can be applied to either a single side of the web or to both sides of the web.

Once applied to paper web 38, the friction reducing composition increases the smoothness of the surface of the web and lowers friction. Some examples of friction reducing compositions that may be used in the process of the present invention are disclosed in U.S. Pat. No. 5,558,873 to Funk, et al., which is incorporated herein by reference.

In one preferred embodiment, the friction reducing composition applied is a quaternary lotion, such as a quaternary silicone spray. For instance, the composition can include a silicone quaternary ammonium chloride. One commercially available silicone glycol quaternary ammonium chloride suitable for use in the present invention is ABIL SW marketed by Goldschmidt Chemical Company of Essen, Germany.

In an alternative embodiment, the friction reducing agent can contain anti-microbial agents for destroying germs that come in contact with the paper web. For instance, one particular commercially available friction reducing spray having anti-microbial properties is DOW 5700 marketed by the Dow-Corning Corporation of Midland, Michigan. DOW 5700 is a silicone quaternary spray that contains anti-microbial agents. Of advantage, DOW 5700 can also be used as a debonding agent during formation of the web. Thus, DOW 5700 or other similar products can also be added during formation of the web.

In a further embodiment, the friction reducing agent can also include a fragrance or odor maskant. The fragrance can be added to the friction reducing agent in order to mask the smell of the silicone composition or can be added to give the resulting tissue product a desired and aesthetic scent.

Quaternary silicone compositions are preferred friction reducing agents in the present application because they bond with the cellulosic fibers contained within the base web. By bonding to the cellulosic fibers, the composition does not transfer onto the user's skin when the tissue product is used. In one embodiment, the friction reducing composition is applied to one side of the paper web in an amount from about 0.4% to about 2% by weight and particularly from about 0.4% to about 1.4% by weight, based upon the weight of the paper web.

After being sprayed with the friction reducing composition, paper web 38 is fed to a dryer 94, such as an infrared dryer. Dryer 94 removes any remaining moisture within the web.

As shown, the web can then be wound into a roll of material 96, which can be transferred to another location and cut into commercial size sheets for packaging as a facial tissue.

Figure 5:
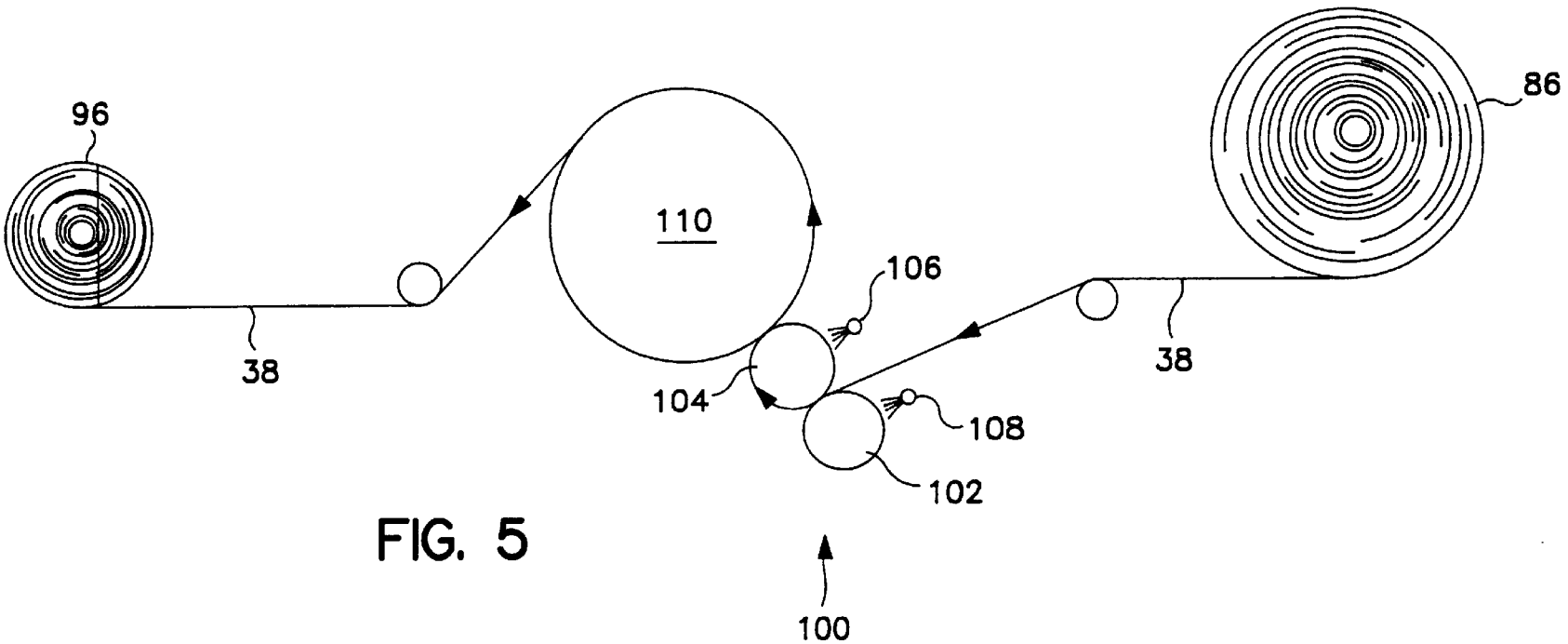
FIG. 5 is a schematic diagram of an alternative embodiment of a system for calendering and applying a friction reducing agent to a paper web in accordance with the present invention.

Referring to FIG. 5, an alternative embodiment of a process for calendering paper web 38 and applying a friction reducing agent is illustrated. As shown, in this embodiment, paper web 38 is fed from roll of material 86 to a combination calendering and friction reducing agent application station generally 100. Station 100 includes a first calender roll 102 which can be, for instance, a smooth steel roll, and a second calender roll 104 which can be, for instance, a hard rubber roll. A sprayer 106 sprays a friction reducing agent onto calender roll 104 which is then evenly distributed onto one side of paper web 38. Optionally, station 100 can further include a second sprayer 108. Sprayer 108 applies a friction reducing agent to calender roll 102 for application to the opposite side of paper web 38.

In the process illustrated in FIG. 5, the friction reducing agent is applied indirectly to paper web 38 by first being sprayed onto calender rolls 102 and 104. In this arrangement, it has been discovered that the friction reducing agent is applied more evenly and uniformly to the paper web. In particular, some friction reducing agents when applied directly to a paper web tend to not evenly distribute over the surface of the web. In the system illustrated in FIG. 5, however, calender rolls 102 and 104 not only smooth out the surface of web 38 but also uniformly apply and distribute the friction reducing agent over the entire surface of the web.

From calender roll 104, paper web 38 is then fed to a heated drum 110 which removes any remaining moisture within the web. The web is then wound into a roll of material 96, which can then be cut into commercial size sheets for packaging.

As described above, applying a friction reducing agent to the paper web of the present invention gives the resulting paper product a smoother and softer feel. It has also been discovered, however, that the friction reducing agent also serves to prevent blocking of the paper sheets after the tissue product has been packaged. As used herein, blocking refers to the propensity of separate sheets of tissue to stick together due to the presence of the latex bonding material. The friction reducing agent, however, appears to prevent the bonding material contained on one sheet from interacting with the bonding material contained on an adjacent sheet.

Facial tissues made according to the above described process provide many advantages and benefits over conventional products and methods. The facial tissues have improved facial softness, low surface friction, high wet strength, good tear resistance, and low lint production. The basis weight of facial tissues made according to the present invention can be from about 20 pounds per 2,880 square feet (ream) to about 25 pounds per ream. After calendering, the ratio of bulk to basis weight for the tissue is between about 10 to about 12 bulk per basis weight units. Of particular advantage, the tissues have great softness and a wet strength of at least 3 ounces and particularly of at least 5 ounces in the cross direction.

The present invention may be better understood with reference to the following example.

EXAMPLE

A single ply facial tissue was made according to the present invention and tested.

Specifically, a single ply facial tissue having a basis weight of 21 pounds per ream was made employing a fiber furnish including 76% by weight Northern softwood kraft fibers, 13% by weight 1.5 denier ¼ inch polyester fibers and 12% by weight eucalyptus fibers. The paper web was produced in a stratified manner such that the polyester fibers and eucalyptus fibers were contained in a middle layer of the web. During formation, the paper web was through dried and moderately creped from a Yankee dryer.

After the paper web was formed, a bonding agent was printed on each side of the web and both sides of the web were creped similar to the process illustrated in FIG. 3. The bonding agent was applied to each side of the web according to a pattern comprising a succession of discrete dots. The bonding agent used was an ethylene vinyl acetate latex.

Once the latex bonding agent was applied to the web and the web was creped on each side, the web was then calendered and a friction reducing agent was applied. The friction reducing agent was a 0.05% silicone emulsion.

Six (6) samples of the facial tissue were then subjected to various standardized tests for strength, brightness and bulk. The following average results were obtained:

TABLE 1

| Characteristics of Single Ply Facial Tissue | |
|---|---|
| Basis Weight | 21 lbs/ream |
| Machine Direction Tensile Strength | 30 oz/in |
| Machine Direction Stretchability | 17.5% |
| Cross Direction Tensile Strength | 10.2 oz/in |
| Cross Direction Stretchability | 30.7% |
| Cross Direction Wet Tensile Strength | 5.6 oz/in |
| Brightness | 86.1 |
| Bulk | 330 |

The above single ply facial tissue produced according to the process of the present invention was observed to have great softness and brightness, while also having good stretch characteristics, strength and absorbency.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A method for producing a single ply soft tissue comprising the steps of:

providing a paper web including a middle layer comprising eucalyptus fibers, a first outer layer comprising softwood fibers and a second outer layer also comprising softwood fibers, said paper web having a first side and a second side;

applying a first bonding agent to said first side of said web in a preselected pattern and adhering said first side of said web to a first creping surface;

creping said first side of said web from said first creping surface;

applying a second bonding agent to said second side of said web in a preselected pattern and adhering said second side of said web to a second creping surface;

creping said second side of said web from said second creping surface; and applying to at least one side of said paper web a friction reducing agent, said friction reducing agent comprising a quaternary silicone composition.

2. A method as defined in claim 1, wherein said middle layer of said paper web further comprises polyester fibers, said polyester fibers being present in an amount from about 5% to about 20% by weight of said web.

3. A method as defined in claim 1, wherein said paper web further comprises a debonding agent, said debonding agent being added to said web in an amount from about 0.2% to about 1% by weight based on the total weight of fibers contained in said web, said debonding agent inhibiting the fibers in said web from bonding together during formation of said paper web.

4. A method as defined in claim 1, wherein said first bonding agent is applied to said first side of said paper web in a pattern that covers from about 30% to about 60% of the surface area of said first side, and wherein said second bonding agent is applied to said second side of said paper web in a pattern that covers from about 30% to about 60% of the surface area of said second side.

5. A method as defined in claim 4, wherein said first bonding agent and said second bonding agent are applied to said first and second sides of said paper web in a combined amount of from about 4% to about 7% by weight of said paper web.

6. A method as defined in claim 5, wherein each of said first bonding agent and said second bonding agent penetrate from about 25% to about 40% of the total thickness of said paper web.

7. A method as defined in claim 6, wherein said first bonding agent and said second bonding agent are applied to said paper web in a preselected pattern that comprises a succession of discrete shapes.

8. A method as defined in claim 1, wherein said first bonding agent and said second bonding agent comprise an ethylene vinyl acetate copolymer cross-linked with N-methyl acrylamide groups.

9. A method as defined in claim 1, further comprising the step of calendering said paper web after creping said second side of said web and prior to applying said friction reducing agent.

10. A method as defined in claim 1, wherein said eucalyptus fibers are added to said paper web in an amount from about 10% to about 35% by weight.

11. A single ply facial tissue made according to the process defined in claim 1, wherein said facial tissue has a basis weight of from about 20 to about 25 pounds per 2,880 square feet of web.

12. A method for producing a single ply soft tissue comprising the steps of:

providing a three-layered paper web including a middle layer comprising eucalyptus fibers, a first outer layer comprising softwood fibers and a second outer layer also comprising softwood fibers, said paper web further comprising a debonding agent added during the formation of said web, said paper web having a first side and a second side;

applying a bonding agent to said first side of said web in a preselected pattern, said bonding agent covering from about 30% to about 60% of the surface area of said first side, said bonding agent being added in an amount from about 2% to about 3.5% by weight based upon the weight of said paper web, said bonding agent being used to adhere said first side of said paper web to a first creping surface;

creping said first side of said web from said first creping surface;

applying said bonding agent to said second side of said web in a preselected pattern, said bonding agent covering from about 30% to about 60% of the surface area of said second side of said web, said bonding agent being added in an amount from about 2% to about 3.5% by weight based on the weight of said paper web, said bonding agent being used to adhere said second side of said web to a second creping surface;

creping said second side of said web from said second creping surface;

calendering said paper web; and applying to at least one side of said paper web a friction reducing agent.

13. A method as defined in claim 12, wherein said bonding agent comprises an alkylene vinyl acetate copolymer.

14. A method as defined in claim 12, wherein said middle layer of said paper web further comprises polyester fibers, said polyester fibers being added in an amount from about 5% to about 20% by weight based on the weight of said paper web.

15. A method as defined in claim 12, wherein said preselected pattern by which said bonding agent is applied to said first side of said web and to said second side of said web comprises a succession of discrete shapes.

16. A method as defined in claim 12, wherein said friction reducing agent comprises a quaternary silicone glycol composition, said friction reducing agent being added in an amount from about 0.4% to about 2% by weight based on the weight of said paper web.

17. A method as defined in claim 12, wherein said paper web that is provided has been creped prior to applying said bonding agent.

18. A method as defined in claim 12, wherein said bonding agent penetrates from about 25% to about 40% of the thickness of said paper web.

19. A method as defined in claim 12, wherein said single ply soft tissue has a basis weight of from about 20 to about 25 pounds per 2,880 square feet and has a wet strength of at least 3 ounces in the cross direction.

20. A method as defined in claim 12, wherein said eucalyptus fibers are present in said paper web in an amount from about 10% to about 35% by weight.

21. A method for producing a single ply soft tissue comprising the steps of:

providing a previously creped three-layered paper web including a middle layer comprising a mixture of eucalyptus and polyester fibers, a first outer layer comprising softwood fibers and a second outer layer also comprising softwood fibers, said paper web including a debonding agent added during formation of said web, said paper web having a first side and a second side;

applying a bonding agent in a preselected pattern, said bonding agent covering from about 40% to about 50% of the area of said first side of said web, said bonding agent being added in an amount from about 2% to about 3.5% by weight based on the weight of said paper web, said bonding agent being used to adhere said first side of said paper web to a first creping surface;

creping said first side of said web from said first creping surface;

applying said bonding agent to said second side of said web in a preselected pattern, said bonding agent covering from about 40% to about 50% of the surface area of said second side of said web, said bonding agent being added in an amount from about 2% to about 3.5% by weight based on the weight of said paper web, said bonding agent being used to adhere said second side of said web to a second creping surface;

creping said second side of said web from said second creping surface;

calendering said paper web;

applying to at least one side of said paper web a friction reducing agent comprising a quaternary silicone composition; and wherein said single ply soft tissue has a basis weight of from about 20 to about 25 pounds per 2,880 square feet.

22. A method as defined in claim 21, wherein said friction reducing agent is added in an amount from about 0.4% to about 2% by weight based on the weight of said paper web.

23. A single ply soft tissue produced according to the process defined in claim 21.

24. A method as defined in claim 21, wherein said bonding agent is applied to said first side and to said second side of said paper web in a preselected pattern that comprises a succession of discrete shapes.

25. A method as defined in claim 21, wherein said friction reducing agent contains an antimicrobial agent.

26. A method as defined in claim 21, wherein said eucalyptus fibers are present within said paper web in an amount from about 10% to about 35% by weight.

27. A method as defined in claim 21, wherein said friction reducing agent is applied indirectly to at least one side of said paper web.

28. A method as defined in claim 21, wherein said friction reducing agent contains a fragrance.

29. A method for producing a single ply soft tissue comprising the steps of:

providing a paper web including a middle layer comprising eucalyptus fibers, a first outer layer comprising softwood fibers and a second outer layer also comprising softwood fibers, said paper web having a first side and a second side;

applying a bonding agent to said first side of said web in a preselected pattern and adhering said first side of said web to a first creping surface;

creping said first side of said web from said first creping surface; and applying to at least one side of said paper web a friction reducing agent.

* * * * *